US009820620B2

(12) United States Patent
Wicker

(10) Patent No.: US 9,820,620 B2
(45) Date of Patent: Nov. 21, 2017

(54) TOWEL COVER

(71) Applicant: Heidi Wicker, Flower Mound, TX (US)

(72) Inventor: Heidi Wicker, Flower Mound, TX (US)

( * ) Notice: Subject to any disclaimer, the term of this patent is extended or adjusted under 35 U.S.C. 154(b) by 0 days.

(21) Appl. No.: 14/660,332

(22) Filed: Mar. 17, 2015

(65) Prior Publication Data

US 2015/0272294 A1 Oct. 1, 2015

Related U.S. Application Data

(60) Provisional application No. 61/970,125, filed on Mar. 25, 2014.

(51) Int. Cl.
*F26B 11/06* (2006.01)
*A47K 10/02* (2006.01)

(52) U.S. Cl.
CPC ..... *A47K 10/02* (2013.01)

(58) Field of Classification Search
CPC .... F26B 3/00; F26B 5/00; F26B 11/00; F26B 11/06; A41B 13/00; A41B 13/06; A47K 10/02
USPC ..... 34/60, 80, 90; D2/864, 864 X; 2/48, 2/49.4; 5/413 R, 484
See application file for complete search history.

(56) References Cited

U.S. PATENT DOCUMENTS 2,430,941 A * 11/1947 Long ..... A41B 13/10 2/49.1
4,856,912 A * 8/1989 Damus ..... A45C 3/10 150/100
5,062,168 A * 11/1991 Kocib ..... A41B 13/06 2/69.5
5,322,918 A * 6/1994 Kirby ..... A47K 10/16 2/48
D398,140 S * 9/1998 Lion ..... D2/860
5,813,080 A * 9/1998 Hendren ..... A63B 57/60 15/118
5,840,675 A * 11/1998 Yeazell ..... A47L 25/08 510/417
6,505,367 B2 * 1/2003 Griffin ..... A47D 5/006 2/48
8,307,462 B1 * 11/2012 Kenney Purcaro .... A41D 13/04 119/650
9,226,626 B2 * 1/2016 Sprague ..... A47K 10/02
(Continued)

FOREIGN PATENT DOCUMENTS

GB 2452486 A * 3/2009 ..... A41D 7/006
JP 2005205079 A * 8/2005

*Primary Examiner* — Stephen M Gravini
(74) *Attorney, Agent, or Firm* — Global Intellectual Property Agency, LLC; Daniel Enea

(57) ABSTRACT

A towel cover for drying hair and preventing frizz is provided. The towel cover includes a unitary sheet of fabric material having an exterior surface and an interior surface. The unitary sheet of fabric material is substantially rectangular. The opposing ends of the interior surface of the unitary sheet of fabric material may be folded to form a cavity. The cavity is configured to receive a towel. At least one fastener may be disposed along at least one edge of the interior surface of the unitary sheet of fabric material. The fastener secures the opposing ends of the interior surface to form the cavity. A towel may be positioned in the cavity between the opposing ends of the interior surface to surround an entire periphery of the towel.

11 Claims, 3 Drawing Sheets

(56) References Cited

U.S. PATENT DOCUMENTS

| | | | | |
|---|---|---|---|---|
| 2007/0084874 | A1* | 4/2007 | Neubauer | A47K 10/18 221/65 |
| 2015/0157431 | A1* | 6/2015 | Ruffin-Proctor | A46B 15/0095 34/95 |
| 2015/0238055 | A1* | 8/2015 | Manno | A47K 10/02 34/95.2 |
| 2015/0272294 | A1* | 10/2015 | Wicker | A47K 10/02 34/96 |
| 2016/0029718 | A1* | 2/2016 | Darnell | A47G 9/062 34/91 |
| 2016/0066628 | A1* | 3/2016 | Shakes | A41D 13/04 2/48 |
| 2016/0088979 | A1* | 3/2016 | Johnson | A42B 1/041 34/96 |
| 2016/0129300 | A1* | 5/2016 | Moore | A63B 21/4037 428/35.5 |

* cited by examiner

TOWEL COVER

CROSS REFERENCE TO RELATED APPLICATION

This application claims the benefit of U.S. Provisional Application No. 61/970,125 filed on Mar. 25, 2014. The above identified patent application is herein incorporated by reference in its entirety to provide continuity of disclosure.

FIELD OF THE INVENTION

The invention generally relates to towels. More particularly, the present invention generally relates to a towel cover for drying hair and preventing frizz, thereby reducing the number of damaging hair care products an individual uses.

BACKGROUND OF THE INVENTION

Hair care is an issue of great importance to many people; therefore a large range of hair-styling products are available to meet demand. Products range from simple styling tools like brushes and combs, to more complicated processes that use chemicals, such as perming and dying treatments, alongside electrically heated styling appliances such as irons and tongs. Unfortunately, in general, more complicated styling products can have damaging effects on hair, stripping it of its natural moisture, and causing damage to the protective cuticle layer, which gives hair its elasticity, strength, and shine.

For example, extensive use of appliances such as hair-dryers and styling tongs can over-dry hair, leaving it brittle and susceptible to breakage, and even brushing or combing hair can lift the cells of the cuticle layer. This eventually exposes the cortex and leads to breakage. Continuous daily use of hair dryers and curling irons can cause irreparable harm to hair and hair follicles.

These adverse problems are compounded by the everyday effects of climate control, pollution and chemical styling products, all of which lead to further damage. Thus, frequent styling often results in dry, damaged, lackluster hair, which eventually becomes prone to frizz, split ends and breakage. Preventing damage to hair is thus an important aspect of hair care.

A variety of products, which aim to protect hair against damage, are available. The most commonly used of these products are conditioners. They are applied to wet hair after washing, and leave a thin coating on each strand of hair, causing the cells of the cuticle layer to close against the shaft, so that hair appears smoother, and has an extra layer of protection. Deep conditioning treatments, which aim to restore moisture to the cortex of the hair are also available, as are styling products, which apply an additional protective layer to the hair to protect against heat damage caused by electrical hair-styling appliances.

However, it is generally accepted that such products can only protect against further damage; they cannot repair damage to hair. Moreover, such products can be expensive and time consuming to apply; therefore, it is important for the hair shaft to be as tame and smooth as possible, in order for styling products to be most beneficial, and to reduce excessive build-up of products as a result of overenthusiastic application.

As a result of modern hair styling, which includes perms, hair extensions and dyes, most hair requires unavoidable high maintenance. Yet the purpose of deep conditioners and treatments is often defeated at the end of the washing cycle, i.e., when excess water is removed from the hair with a cotton towel. Hair is at its most vulnerable when wet, but after washing, the seemingly innocuous action of towel drying is often regarded as a vital step towards good hair care, but unfortunately this inflicts unintended damage as a result of rigorous rubbing and tugging, which inevitably causes hair the snag and/or break.

As with aggressive brushing and combing, the friction resulting from rubbing an abrasive cotton towel against hair can cause damage to the cells of the cuticle layer, eventually exposing the cortex and leaving the hair-shaft weak and vulnerable. Moreover, the friction resulting from towel drying can cause hair, which is already weakened as a result of damage caused by styling, to break at points of weakness. Friction as a result of towel drying is a particular problem with long hair, where the ends of the hair may be several years old or where the hair has been exposed to repeated chemical processes.

Therefore, hairdressers and other hair care professionals often advise clients with long hair, and/or particularly fragile hair, not to use a towel to dry their hair. However, without towel drying, it can take a long time for hair to dry naturally. This can be inconvenient in circumstances where it is necessary to style hair immediately after washing. Under these circumstances, it can be tempting to begin styling hair before it is sufficiently dry. This is likely to be less effective than styling hair when it is dry, and may increase the likelihood of damaged hair, if using electrically heated appliances such as irons or tongs. Thus, there is a need for a device that can effectively aid in drying hair without damaging or weakening hair.

SUMMARY OF THE INVENTION

In view of the foregoing disadvantages inherent in the known types of towels now present in the prior art, the present invention provides a towel cover wherein the same can be utilized for providing convenience for the user when drying hair and preventing frizz.

It is one object of the present invention to provide a towel cover for drying hair and preventing frizz. The towel cover includes a unitary sheet of fabric material having an exterior surface and an interior surface. The unitary sheet of fabric material is substantially rectangular. A cavity is formed by folding opposing ends of the interior surface of the unitary sheet of fabric material. The cavity is configured to receive a towel.

It is another object of the present invention to provide a towel cover having at least one fastener disposed along an edge of the interior surface of the unitary sheet of fabric material. The fastener secures the opposing ends of the interior surface to form the cavity. A towel is positioned in the cavity between the opposing ends of the interior surface to surround an entire periphery of the towel.

It is yet another object of the present invention to provide a towel cover wherein the fastener is a hook and loop fastening material with mating surfaces disposed along opposing lengths of the interior surface.

Another object of the present invention is to provide a towel cover adapted to receive a towel in the interior surface of the unitary sheet of fabric material before the fasteners secure the opposing ends of the interior surface.

In another embodiment of the present invention the unitary sheet is composed of a fine cotton material, rayon, cotton, or a cotton-polyester blend. In a preferred embodiment, the unitary sheet of fabric material comprises a moisture wicking material.

According to another embodiment of the present invention, the exterior surface comprises a cotton-silk blend. The exterior surface may also be made of a wadding or sponge-like material.

In still yet another embodiment of the present invention, at least two edges of the unitary sheet are sewn together.

According to another example embodiment of the present invention, the unitary sheet of fabric material has an open configuration for receiving a towel. The unitary sheet of fabric material may also have a closed configuration for securing a towel.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Figure 1:
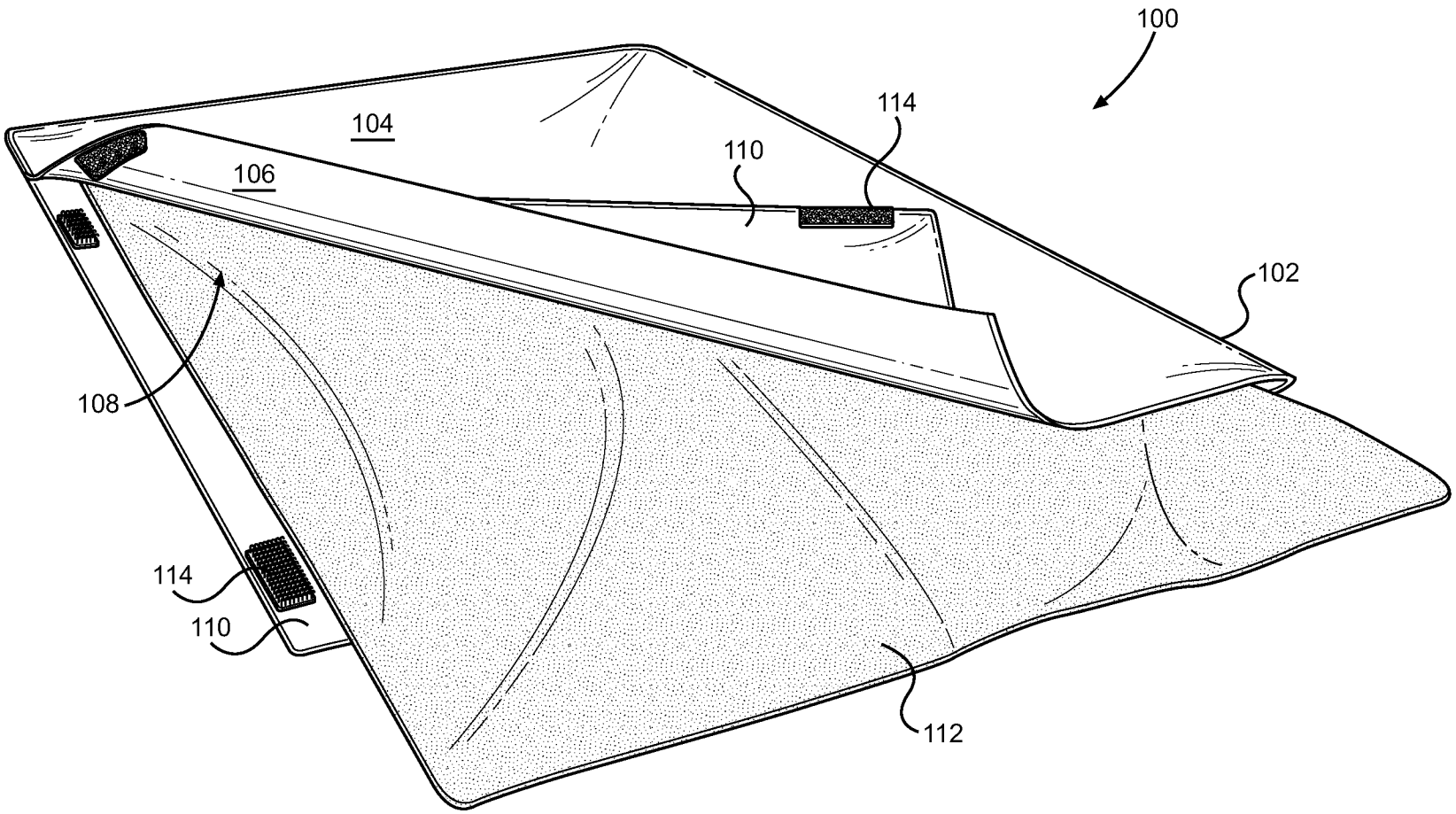
FIG. 1 shows a perspective view of the towel cover with a towel secured therein according to one embodiment of the present invention.

FIGS. 3A-D show an assembly of the towel cover according to different embodiments of the present invention.

DETAILED DESCRIPTION OF THE INVENTION

Reference is made herein to the attached drawings. Like reference numerals are used throughout the drawings to depict like or similar elements of the towel cover. For the purposes of presenting a brief and clear description of the present invention, the preferred embodiment will be discussed as used for receiving a towel and drying hair. The figures are intended for representative purposes only and should not be considered to be limiting in any respect.

Referring now to FIG. 1, there is shown a perspective view of the towel cover with a towel secured therein according to one embodiment of the present invention. The towel cover 100 for drying hair and preventing frizz includes a unitary sheet 102 of fabric material having an exterior surface 104 and an interior surface 106. The unitary sheet 102 of fabric material is preferably rectangular in shape. However, it is contemplated that the unitary sheet 102 can have multiple shapes and sizes for receiving towels of different configurations. The unitary sheet 102 of fabric material may comprise a fine material that aids in removing moisture. In a preferred embodiment, the fabric material comprising the unitary sheet is a fine cotton material, rayon, or cotton-polyester blend.

The unitary sheet of 102 fabric material may further include a cavity 108. The cavity is formed by folding opposing ends 110 of the unitary sheet 102 of fabric material. The opposing ends 110 of the interior surface 106 are fastened together to provide an enclosure of the fabric material within the cavity 108. The cavity is 108 configured to receive a towel 112 or other similar fabric material that aids in the removal of moisture from hair.

At least one fastener 114 may be disposed along at least one edge 116 of the interior surface 106 of the unitary sheet 102 of fabric material. The fastener 114 secures the opposing ends 110 of the interior surface 106 to form the cavity 108. According to one embodiment, the at least one fastener 114 is a hook and loop material with mating surfaces disposed along opposing ends 110 of the interior surface 106. It is also contemplated that the fastener can be clips, a snap button, clamp, or a hook and eye closure.

A towel 112 may be positioned in the cavity 108 between the opposing ends 110 of the interior surface 106. The unitary sheet 102 of fabric material surrounds the entire periphery of the towel 112 when a towel is placed in the cavity 108 formed by the unitary sheet 102. The towel 112 may be placed on the interior surface 106 of the unitary sheet 102 of fabric material before the at least one fastener 114 secures the opposing ends 110 of the interior surface 106.

Figure 2:
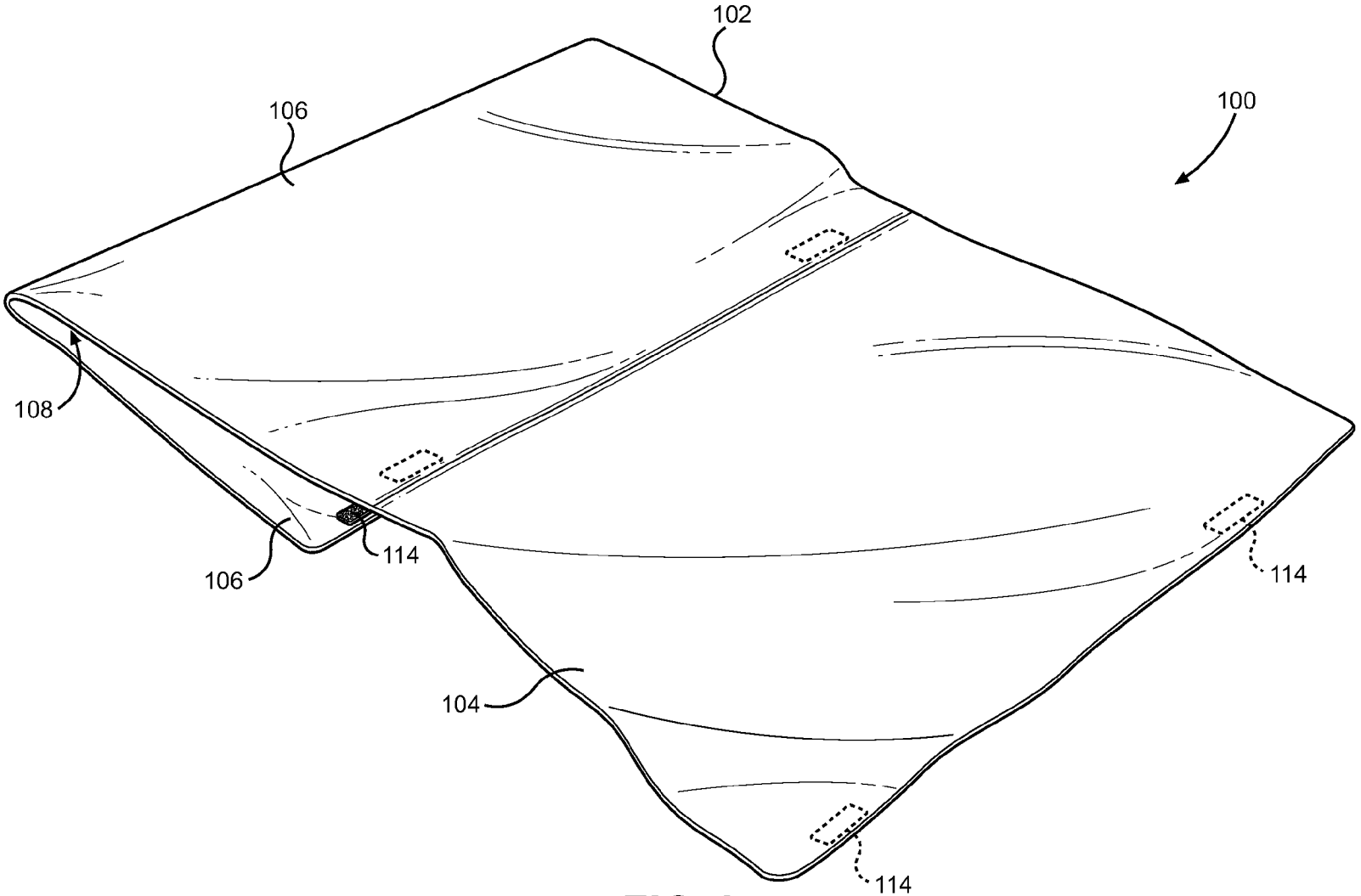
FIG. 2 shows a perspective view of the towel cover according to one embodiment of the present invention.
Figure 3A:
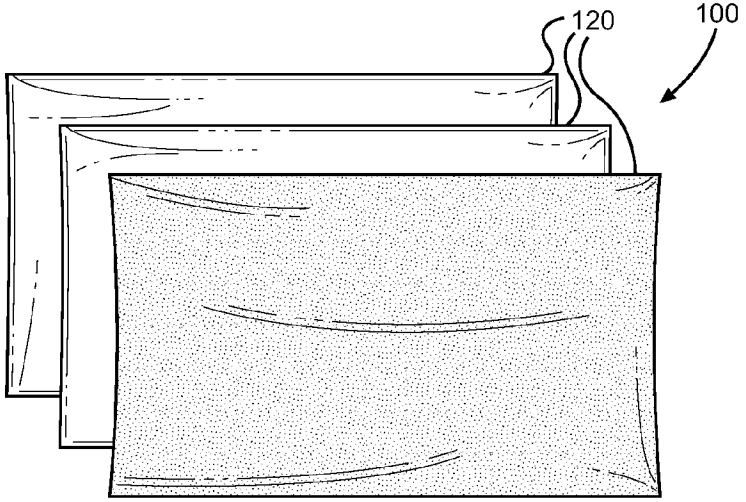
Figure 3B:
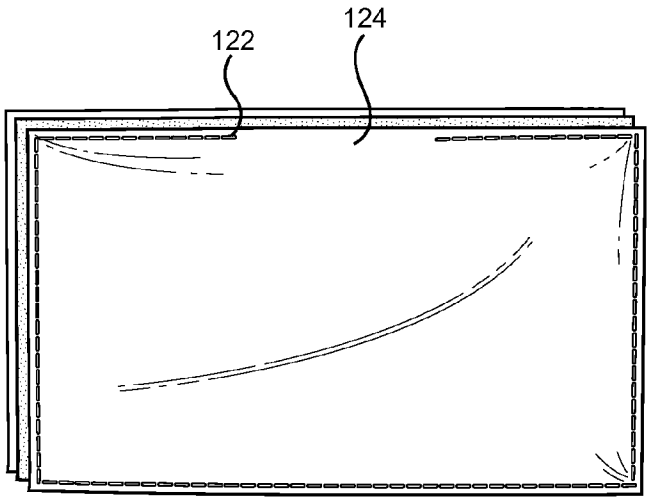
Figure 3C:
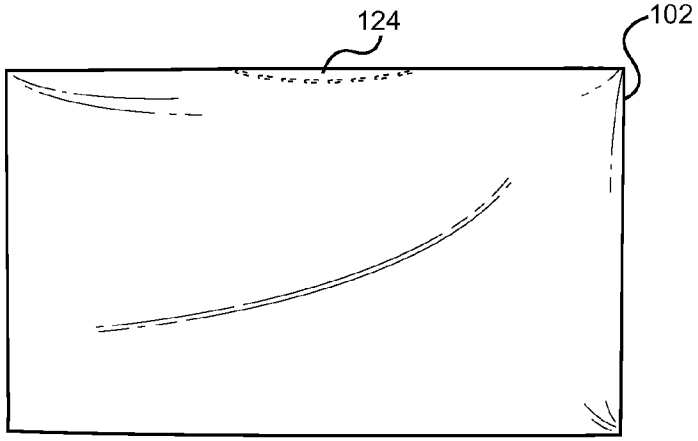
Figure 3D:
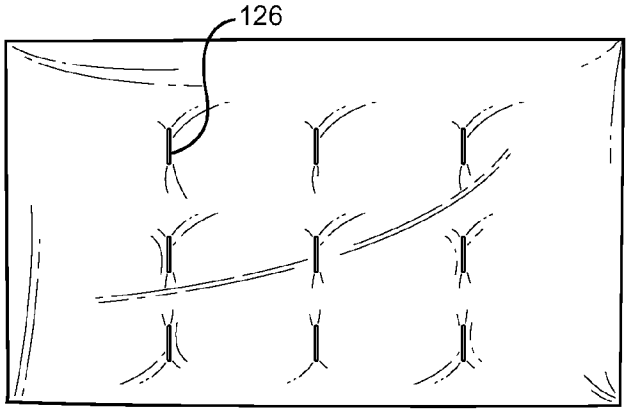

Referring now to FIG. 2, there is shown a perspective view of the towel cover according to one embodiment of the present invention. The towel cover 100 may include a substantially rectangular sheet of material 102 with a plurality of fastening means 114 disposed along at least one edge 106 of the towel cover 100. In the depicted embodiment, the fastener comprises complementary hook-and-loop fastening material mating surfaces disposed along opposing edges of the towel cover 100. In use, a towel is placed within the towel cover, the towel cover is then folded over the towel, and the opposing edges of the towel cover are affixed together to secure the towel therein.

In one embodiment, the interior surface 106 of the towel cover 100 is in communication with the towel. The exterior surface 104 may comprise a cotton-polyester blend or a wadding sponge-like material. In one embodiment, the at least two edges of the unitary sheet 102 of fabric material are sewn together. The unitary sheet 102 of fabric material has an open configuration for receiving a towel and a closed configuration for securing a towel.

Referring now to FIG. 3A-D, there is shown an assembly of the towel cover according to one example embodiment of the present invention. The towel cover 100 may comprise three layers 120 of fabric material to form the unitary sheet 102 of fabric material. The three layers 120 of fabric material may be sewn together to provide the towel cover 100. The three layers 120 include at two least exterior layers and an interior layer. The layers are stitched 122 together along the edges and provides an opening 124 at the top of the towel cover 100 to flip the towel cover 100 inside out. Finally, darts 126 are stitched along the towel cover 100. The darts 126 are sewn into the towel cover 100 to provide a tailored shape for the towel cover 100.

In another embodiment, the unitary sheet 102 may be fabricated from layered sheets of fabric material. The unitary sheet 102 may include a first layer, a second layer and a third layer, wherein the first layer and the third are made of identical fabric materials. The second layer is disposed between the first layer and the third layer.

The three layers of fabric material may comprise a terry cloth material and a cotton or polyester. In one embodiment, the exterior layers, the first layer and the third layer, comprise of a cotton or polyester material and the interior layer, the second layer, comprise of a terry cloth material. The terry cloth material may be arranged in between the materials. The t-shirt materials have smooth interior surfaces with finished sides, wherein the smooth interior surface of the t-shirt material contacts the terry cloth material disposed between the two t-shirt materials. The layers of fabric are then stitched together along the edges such that the t-shirt layers are disposed on the outside. A small unstitched opening is disposed on the top portion of the layered fabric, such that the fabric material can be turned right side out. A hidden stitch may be used to sew up the unstitched opening. Darts may be sewn along the length of the unitary sheet to allow the layered materials to be secured.

The towel cover 100 may be provided in a number of different sizes and shapes to conform to differently shaped towels. The present invention may preferably be composed of cotton, rayon, cotton/polyester blend, or a knit material. Once the towel cover is affixed over a towel, the towel cover and the towel can be used in combination together in the same manner as a towel is normally used.

The towel cover 100 is composed of finer material than conventional towels are composed of, thereby allowing the present invention to wick away water from the individual's hair more quickly and without requiring that the individual vigorously rub his or her hair to get it dry. This finer material thereby reduces damage to the cuticle of the hair, which reduces the amount of frizzing in the hair. In some embodiments, the towel cover may be fabricated from rayon, cotton, or a cotton-polyester blend.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A towel cover for drying hair and preventing fizz, comprising:

a unitary sheet of fabric material having an exterior surface and an interior surface, wherein the unitary sheet of fabric material is substantially rectangular;

a cavity formed by folding opposing ends of the interior surface of the unitary sheet of fabric material, the cavity configured to receive a towel;

at least two fasteners disposed along opposing edges of the interior surface of the unitary sheet of fabric material, wherein the at least two fasteners secure the opposing ends of the interior surface to form the cavity; and wherein the towel is positioned in the cavity between the opposing ends of the interior surface, wherein the unitary sheet surrounds an entire periphery of the towel;

the unitary sheet comprising a second panel disposed between a first panel and a third panel, a first set of fasteners disposed on the first panel correspond to a second set of fasteners disposed on the second panel, wherein folding of the first panel to coextensively overlap the second panel causes the first set of fasteners and the second set of fasteners to align and secure therewith;

wherein folding of the third panel to coextensively overlap both the first panel and the second panel causes a third set of fasteners to align and secure with the first panel; and wherein each of first set, the second set, and the third set of fasteners include a pair of hook and loop fasteners spaced at an interval along an edge of the panel.

2. The towel cover of claim 1, wherein the fastener is a hook and loop material with mating surfaces disposed along opposing lengths of the interior surface.

3. The towel cover of claim 1, wherein the unitary sheet is composed of a fine cotton material.

4. The towel cover of claim 1, wherein the exterior surface comprises a cotton/polyester blend.

5. The towel cover of claim 1, wherein the exterior surface is made of a wadding or sponge-like material.

6. The towel cover of claim 1, wherein at least two edges of the unitary sheet are sewn together.

7. The towel cover of claim 1, wherein the unitary sheet of fabric material comprises a moisture wicking material.

8. The towel cover of claim 1, wherein the unitary sheet of fabric material comprises a plurality of layers of fabric sewn together.

9. The towel cover of claim 8, wherein the plurality of layers includes a first layer and a second layer comprising a cotton material and a third layer comprising a terry cloth material, wherein the terry cloth material is disposed between the cotton material.

10. The towel cover of claim 1, further comprising darts sewn along a length of the unitary sheet of fabric material.

11. The towel cover of claim 8, wherein one or more darts disposed in a grid configuration join together the plurality of layers of fabric at fixed intervals.

* * * * *